US011401144B2

(12) United States Patent
Na

(10) Patent No.: US 11,401,144 B2
(45) Date of Patent: Aug. 2, 2022

(54) FORK MOVEMENT CONTROL DEVICE

(71) Applicant: DOOSAN CORPORATION, Seoul (KR)

(72) Inventor: Ki Eop Na, Chungcheongbuk-do (KR)

(73) Assignee: DOOSAN CORPORATION, Seoul (KR)

( * ) Notice: Subject to any disclaimer, the term of this patent is extended or adjusted under 35 U.S.C. 154(b) by 624 days.

(21) Appl. No.: 16/322,532

(22) PCT Filed: Aug. 2, 2017

(86) PCT No.: PCT/KR2017/008326
§ 371 (c)(1),
(2) Date: Feb. 1, 2019

(87) PCT Pub. No.: WO2018/026184
PCT Pub. Date: Aug. 2, 2018

(65) Prior Publication Data

US 2019/0202676 A1 Jul. 4, 2019

(30) Foreign Application Priority Data

Aug. 2, 2016 (KR) ..... 10-2016-0098385

(51) Int. Cl.
*B66F 9/22* (2006.01)
*F15B 13/02* (2006.01)
(Continued)

(52) U.S. Cl.
CPC ..... *B66F 9/22* (2013.01); *B66F 9/142* (2013.01); *B66F 17/003* (2013.01); *F15B 13/02* (2013.01);
(Continued)

(58) Field of Classification Search
CPC ... B66F 9/22; B66F 9/142; F66F 17/00; F66F 17/003; F15B 2211/305; F15B 2211/405;
(Continued)

(56) References Cited

U.S. PATENT DOCUMENTS 2,795,346 A * 6/1957 Farmer ..... B66F 9/183 254/2 R
3,184,088 A * 5/1965 Berge ..... B66F 9/183 414/621
(Continued)

FOREIGN PATENT DOCUMENTS

JP 2003104178 A 4/2003
KR 10-2006-0070263 A 6/2006
KR 10-2011-0073080 A 6/2011

OTHER PUBLICATIONS

International Search Report issued in corresponding International Patent Appln No. PCT/KR2017/008326 dated Nov. 6, 2017, consisting of 6 pp. (English Translation Provided).
(Continued)

*Primary Examiner* — Dustin T Nguyen
(74) *Attorney, Agent, or Firm* — Volpe Koenig

(57) ABSTRACT

The present disclosure relates to a fork movement control device. A fork movement control device according to an exemplary embodiment of the present disclosure may control and simultaneously move two forks by manipulating a single lever.

4 Claims, 13 Drawing Sheets

(51) Int. Cl.
*B66F 9/14* (2006.01)
*B66F 17/00* (2006.01)

(52) U.S. Cl.
CPC ... *F15B 2211/305* (2013.01); *F15B 2211/405* (2013.01); *F15B 2211/7051* (2013.01)

(58) Field of Classification Search
CPC ..... F15B 2211/7051; F15B 2211/3116; F15B 13/02
See application file for complete search history.

(56) References Cited

U.S. PATENT DOCUMENTS

| | | | | | |
|---|---|---|---|---|---|
| 3,692,198 | A * | 9/1972 | Lake | B66F 9/183 414/621 |
| 4,335,992 | A * | 6/1982 | Reeves | B66F 9/146 414/667 |
| 5,088,880 | A | 2/1992 | Field | |
| 10,494,241 | B2 * | 12/2019 | Petronek | B66F 9/146 |

OTHER PUBLICATIONS

Written Opinion issued in corresponding International Patent Appln. No. PCT/KR2017/008326 dated Nov. 6, 2017, consisting of 5 pp.

* cited by examiner

FORK MOVEMENT CONTROL DEVICE

TECHNICAL FIELD

The present disclosure relates to a fork movement control device capable of controlling a pair of forks provided on a forklift so that the pair of forks simultaneously moves in any one of the left and right directions.

BACKGROUND ART

In general, a forklift may have a pair of forks at a front side thereof. An example in which the pair of forks is provided will be described with reference to the attached FIGS. 1 to 3.

The attached FIGS. 1 to 3 are views for explaining a configuration in which a pair of forks is mounted on a forklift according to a comparative example.

A carriage frame 10 has first and second cylinders 21 and 31 and a single shift cylinder 41.

In addition, the carriage frame 10 has a side shift frame 50, and the single shift cylinder 41 may be installed on the side shift frame 50. A rod 42 of the single shift cylinder 41 is connected to the carriage frame 10.

A first fork 23 may be moved by the first cylinder 21, and a second fork 33 may be moved by the second cylinder 31.

Further, the carriage frame 10 may be moved in a left or right direction relative to the side shift frame 50 by the single shift cylinder 41.

Ideally, the pair of forks is positioned at a position at which a center of gravity of an article is positioned when carrying the article by using the forklift.

That is, the forklift may repeatedly travel forward and backward to set the positions of the forks with respect to the article. However, when the positions of the forks slightly deviate from the accurate positions, the positions of the forks may be sometimes adjusted to the accurate positions only by moving the forks by several centimeters, for example. In this case, the forklift may lift up the article by adjusting the positions of the forks without traveling.

The forklift according to the comparative example may move the two forks in a desired direction by operating the single shift cylinder 41.

As described above, the forklift according to the comparative example needs to necessarily operate the single shift cylinder 41 and necessarily have the side shift frame 50 in order to simultaneously move the two forks.

On the other hand, since the forklift according to the comparative example has the side shift frame 50, an operator's visual field is obstructed by the side shift frame 50, which causes a disadvantage in terms of ensuring the visual field.

DISCLOSURE

Technical Problem

Accordingly, a technical object of the present disclosure is to provide a fork movement control device which excludes the single shift cylinder and the side shift frame provided in the comparative example but may simultaneously move two forks by manipulating a single lever, thereby contributing to a reduction in costs incurred to manufacture a forklift by excluding the single shift cylinder and the side shift frame.

In addition, another object of the present disclosure is to provide a fork movement control device which excludes the side shift frame, thereby contributing to ensuring an operator's visual field.

Technical Solution

To achieve the technical objects, a fork movement control device according to an exemplary embodiment of the present disclosure includes: a first control valve unit 110 which is connected to a first head port 25 of a first cylinder 21 through a first flow path line L1 and connected to a first tail port 26 of the first cylinder 21 through a second flow path line L2; a second control valve unit 120 which is connected to a second head port 35 of a second cylinder 31 through a third flow path line L3 and connected to a second tail port 36 of the second cylinder 31 through a fourth flow path line L4; a third control valve unit 130 which is connected to the first flow path line L1 through a fifth flow path line L5 and connected to the third flow path line L3 through a sixth flow path line L6; and a seventh flow path line L7 which connects the second flow path line L2 and the fourth flow path line L4 so that the first tail port 26 and the second tail port 36 are connected.

In addition, the first, second, and third control valve units 110, 120, and 130 of the fork movement control device according to the exemplary embodiment of the present disclosure may include: first, second, and third neutral positions 113*a*, 123*a*, and 133*a* at which a flow of a working fluid is stopped; first, second, and third forward direction positions 113*b*, 123*b*, and 133*b* at which the flow of the working fluid is controlled so that the working fluid flows in a forward direction; and first, second, and third reverse direction positions 113*c*, 123*c*, and 133*c* at which the flow of the working fluid is controlled so that the working fluid flows in a reverse direction, respectively.

In addition, when the third forward direction position 133*b* or the third reverse direction position 133*c* of the third control valve unit 130 is selected, the first neutral position 113*a* of the first control valve unit 110 may be selected or the second neutral position 123*a* of the second control valve unit 120 may be selected.

Other detailed matters of the exemplary embodiment are included in the detailed description and the drawings.

Advantageous Effects

The fork movement control device according to the exemplary embodiment of the present disclosure, which is configured as described above, may control and simultaneously move the two forks by manipulating the single lever even though the single shift cylinder and the side shift frame in the related art are excluded.

In addition, the fork movement control device according to the exemplary embodiment of the present disclosure excludes the side shift frame in the related art, thereby reducing the number of obstacles that obstruct the operator's visual field and enabling the operator to have a wider visual field.

DESCRIPTION OF MAIN REFERENCE NUMERALS OF DRAWINGS

Figure 1:
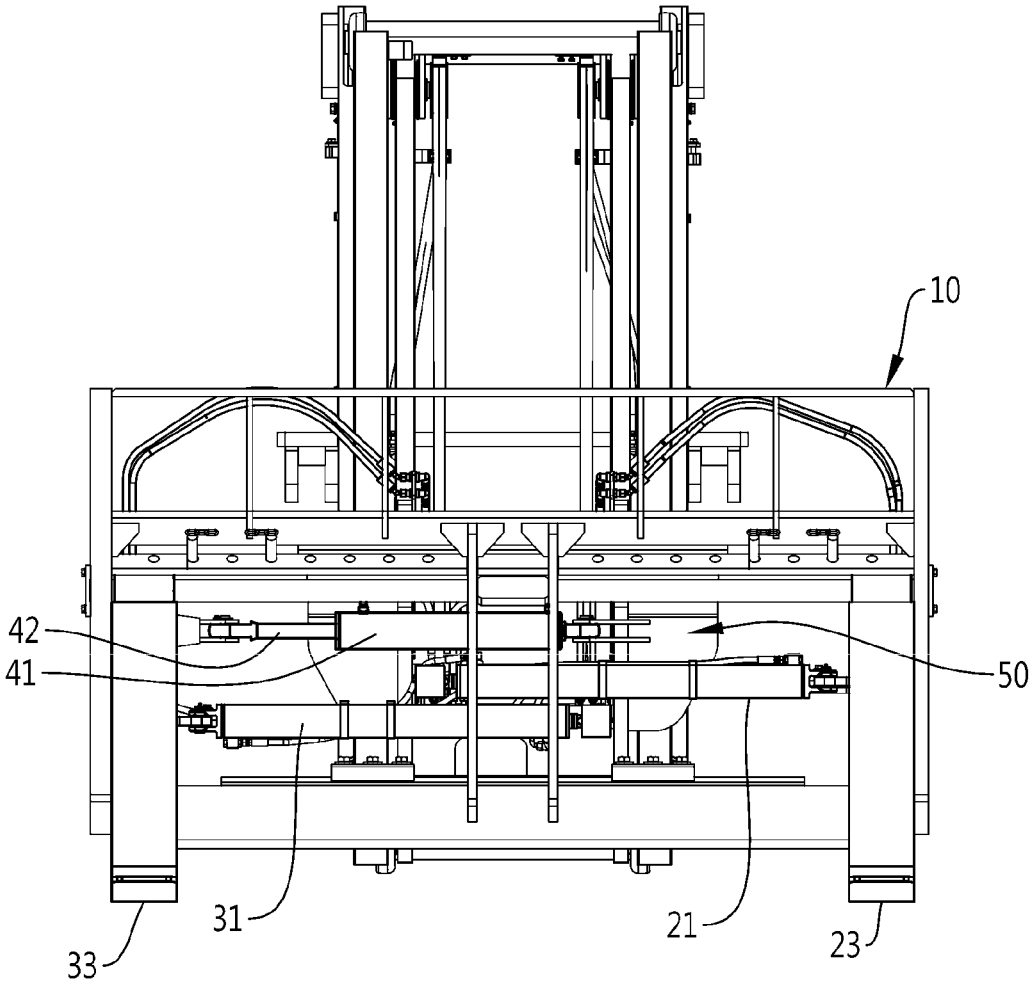
FIG. 1 is an elevated view of a pair of forks mounted on a forklift according to a comparative example.
Figure 2:
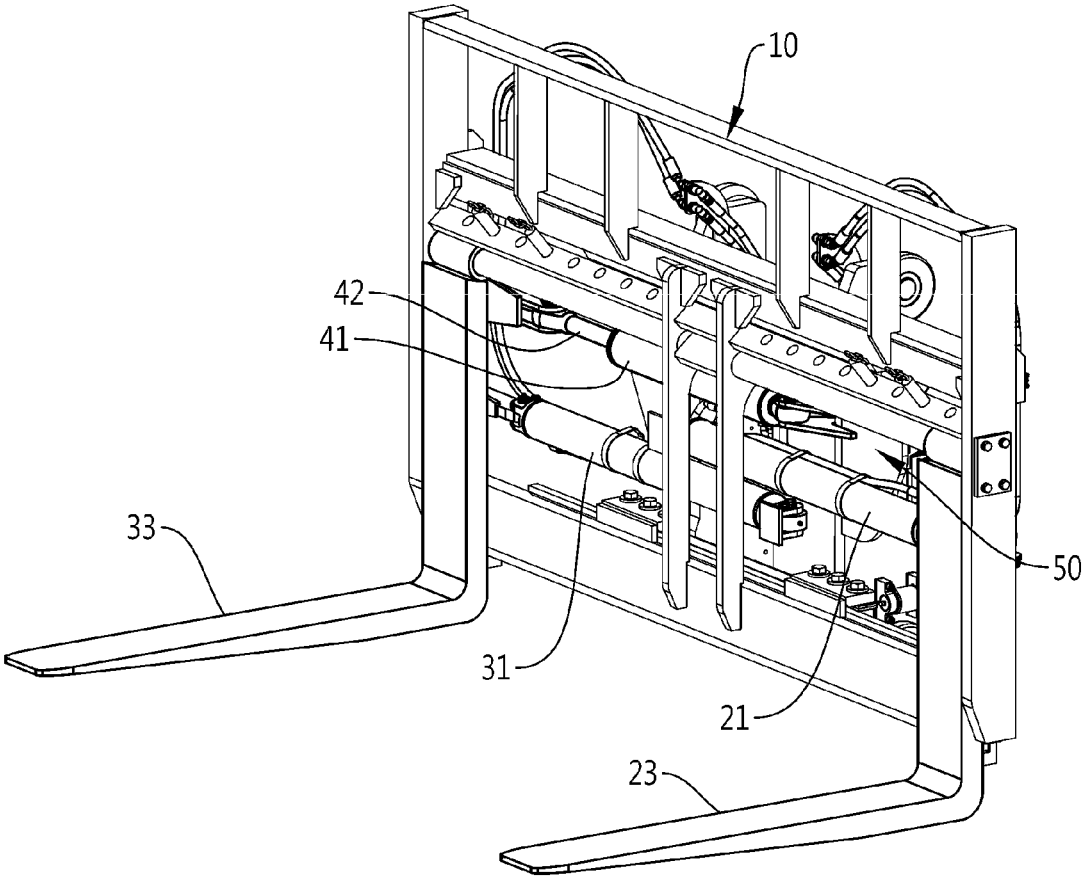
FIG. 2 is a perspective view of the pair of forks and mounting assembly of the comparative example of FIG. 1.
Figure 3:
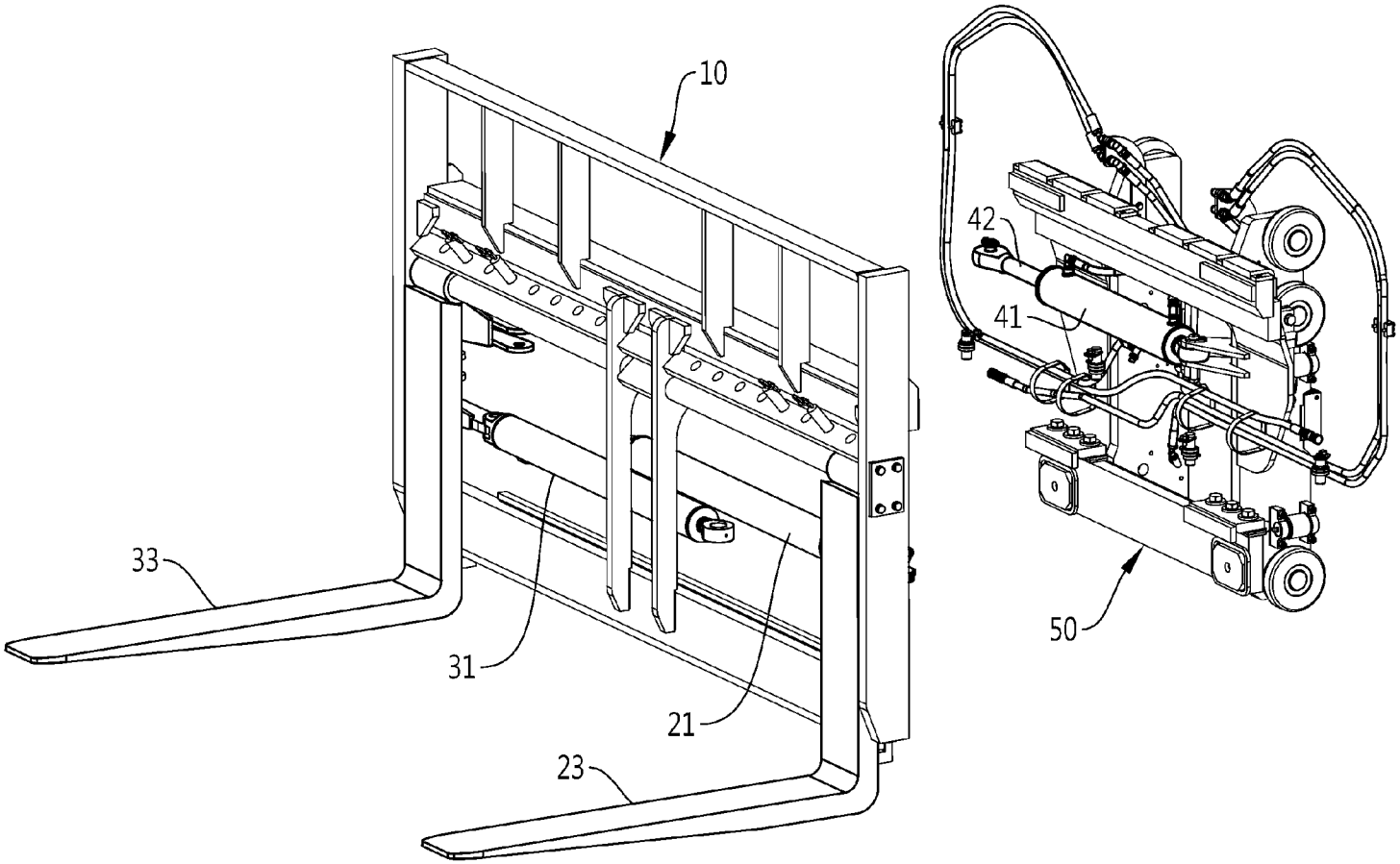
FIG. 3 is an expanded perspective view of the pair of forks and the respective mounting assembly of the comparative example of FIG. 1.

10: Carriage frame
21, 31: First and second cylinders
22, 32: First and second rods
23, 33: First and second forks
25, 35: First and second head ports
26, 36: First and second tail ports
41: Single shift cylinder
42: Rod
50: Side shift frame
91: Center bypass line
92: Parallel line
93: Drain line
110, 120, 130: First, second, and third control valve units
111, 112, 121, 122, 131, 132: Eleventh, twelfth, twenty-first, twenty-second, thirty-first, and thirty-second pressure receiving parts
113*a*, 123*a*, 133*a*: First, second, and third neutral positions
113*b*, 123*b*, 133*b*: First, second, and third forward direction positions
113*c*, 123*c*, 133*c*: First, second, and third reverse direction positions
L1 to L7: First to seventh flow path lines

BEST MODE

Advantages and features of the present disclosure and methods of achieving the advantages and features will be clear with reference to exemplary embodiments described in detail below together with the accompanying drawings.

Hereinafter, exemplary embodiments of the present disclosure will be described in detail with reference to the accompanying drawings. The exemplary embodiments to be described below are illustrative for helping understand the present disclosure, and it should be understood that the present disclosure may be carried out by being modified in various ways different from the exemplary embodiments described herein. However, in the description of the present disclosure, the specific descriptions and illustrations of publicly known functions or constituent elements will be omitted when it is determined that the specific descriptions may unnecessarily obscure the subject matter of the present disclosure. In addition, to help understand the present disclosure, the accompanying drawings are not illustrated based on actual scales, but some constituent elements may be exaggerated in size.

Meanwhile, the terms such as "first" and "second" may be used to describe various constituent elements, but the constituent elements should not be limited by the terms. These terms are used only to distinguish one constituent element from another constituent element. For example, a first component may be named a second component, and similarly, the second component may also be named the first component, without departing from the scope of the present disclosure.

Meanwhile, the terms used in the description are defined considering the functions of the present disclosure and may vary depending on the intention or usual practice of a manufacturer. Therefore, the definitions should be made based on the entire contents of the present specification.

Like reference numerals indicate like constituent elements throughout the specification.

Figure 4:
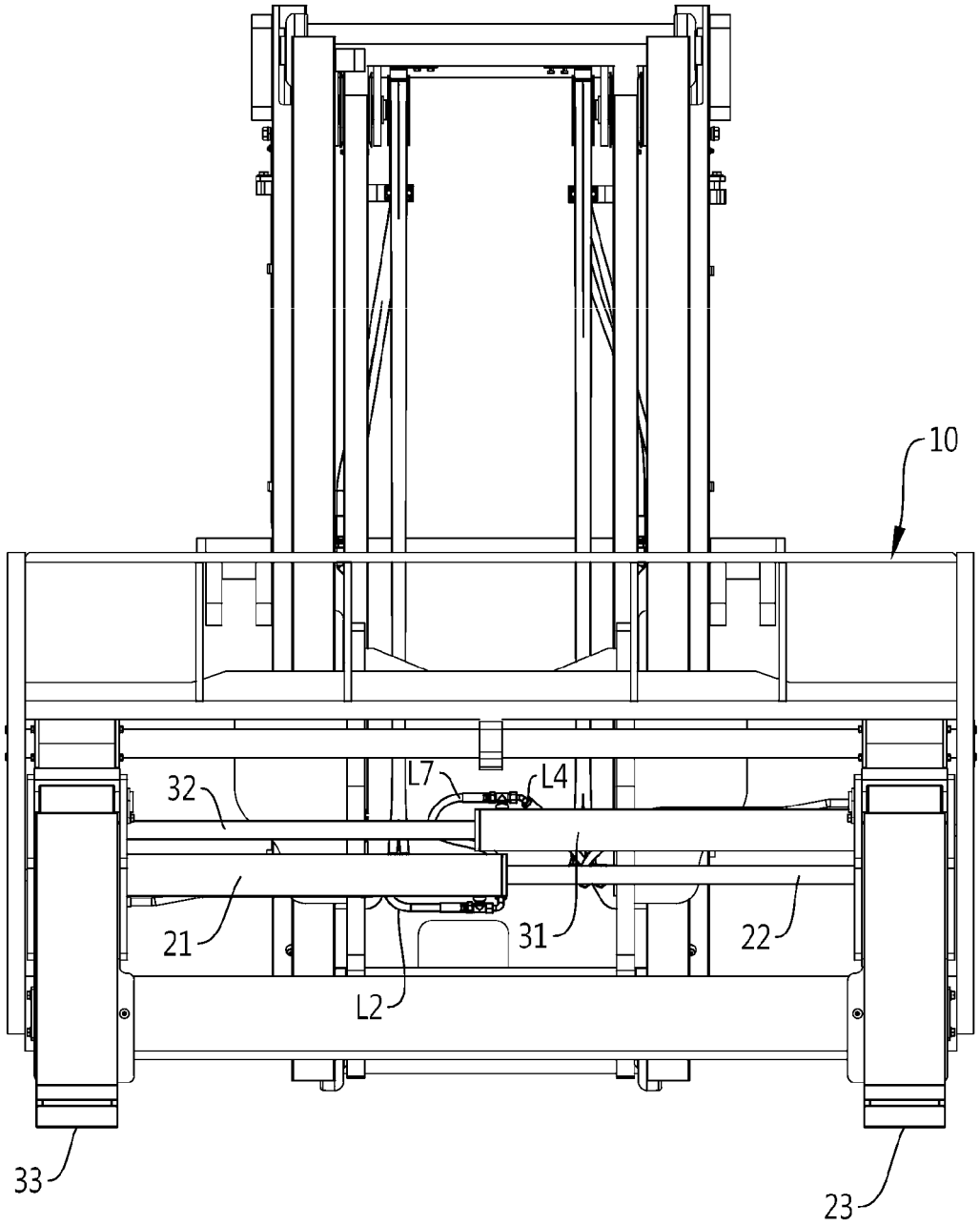
FIG. 4 is an elevated view of a pair of forks is mounted on a forklift according to an exemplary embodiment of the present disclosure.
Figure 5:
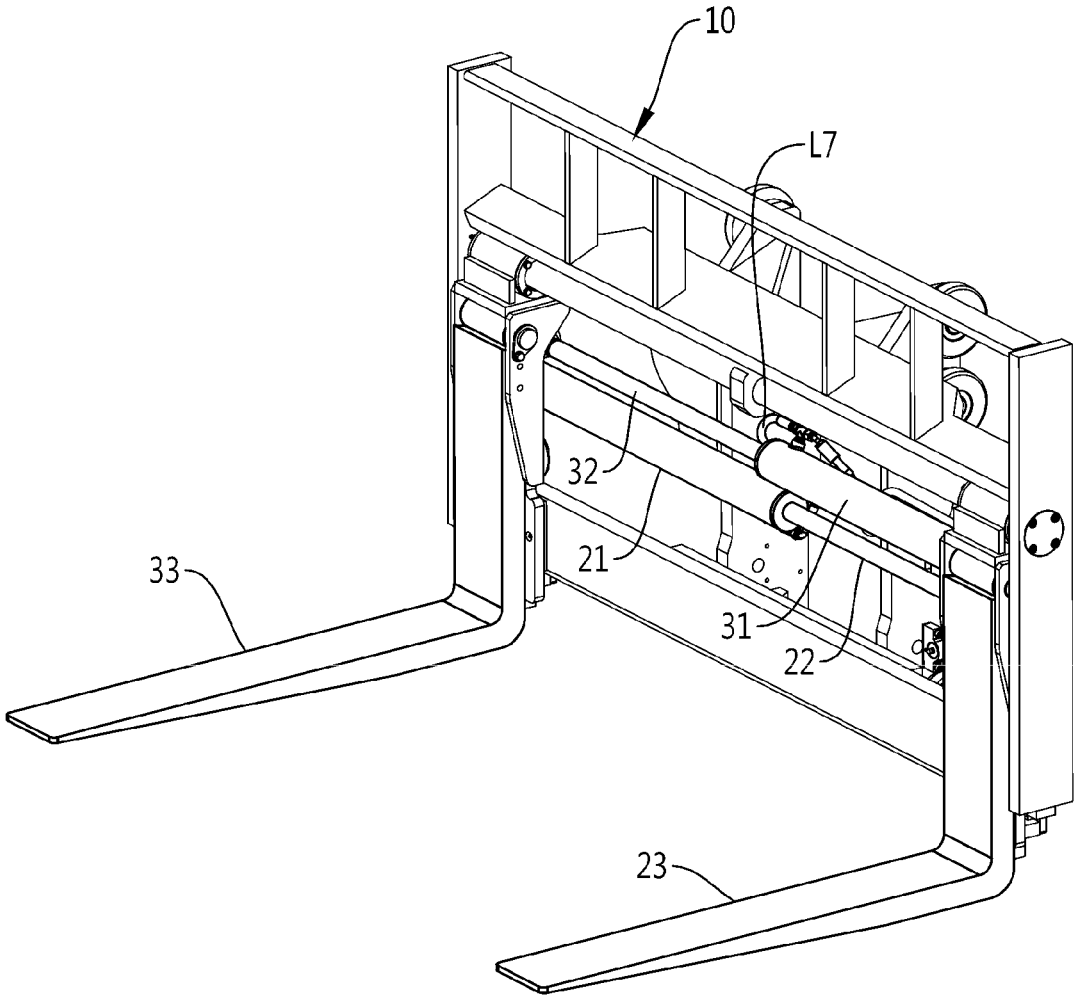
FIG. 5 is a perspective view of the pair of forks and mounting assembly of the comparative example of FIG. 4.

First, the configuration in which a pair of forks is mounted on a forklift according to an exemplary embodiment of the present disclosure will be described with reference to FIGS. 4 and 5. FIGS. 4 and 5 are views for explaining the configuration in which the pair of forks is mounted on the forklift according to the exemplary embodiment of the present disclosure.

The forklift according to the exemplary embodiment of the present disclosure has a pair of forks 23 and 33 provided on a carriage frame 10. In addition, first and second cylinders 21 and 31 may be provided on the carriage frame 10.

The first fork 23 is connected to a first rod 22 of the first cylinder 21. The first fork 23 is moved outward when the first cylinder 21 is extended, and the first fork 23 is moved inward when the first cylinder 21 is retracted.

Likewise, the second fork 33 is connected to a second rod 22 of the second cylinder 31. The second fork 33 is moved outward when the second cylinder 31 is extended, and the second fork 33 is moved inward when the second cylinder 31 is retracted.

Meanwhile, a direction in which the first cylinder 21 is disposed and a direction in which the second cylinder 31 is disposed are opposite to each other. That is, a width between the two forks is increased when the first cylinder 21 and the second cylinder 31 are simultaneously extended. On the contrary, the width between the two forks is decreased when the first cylinder 21 and the second cylinder 31 are simultaneously retracted.

Figure 6:
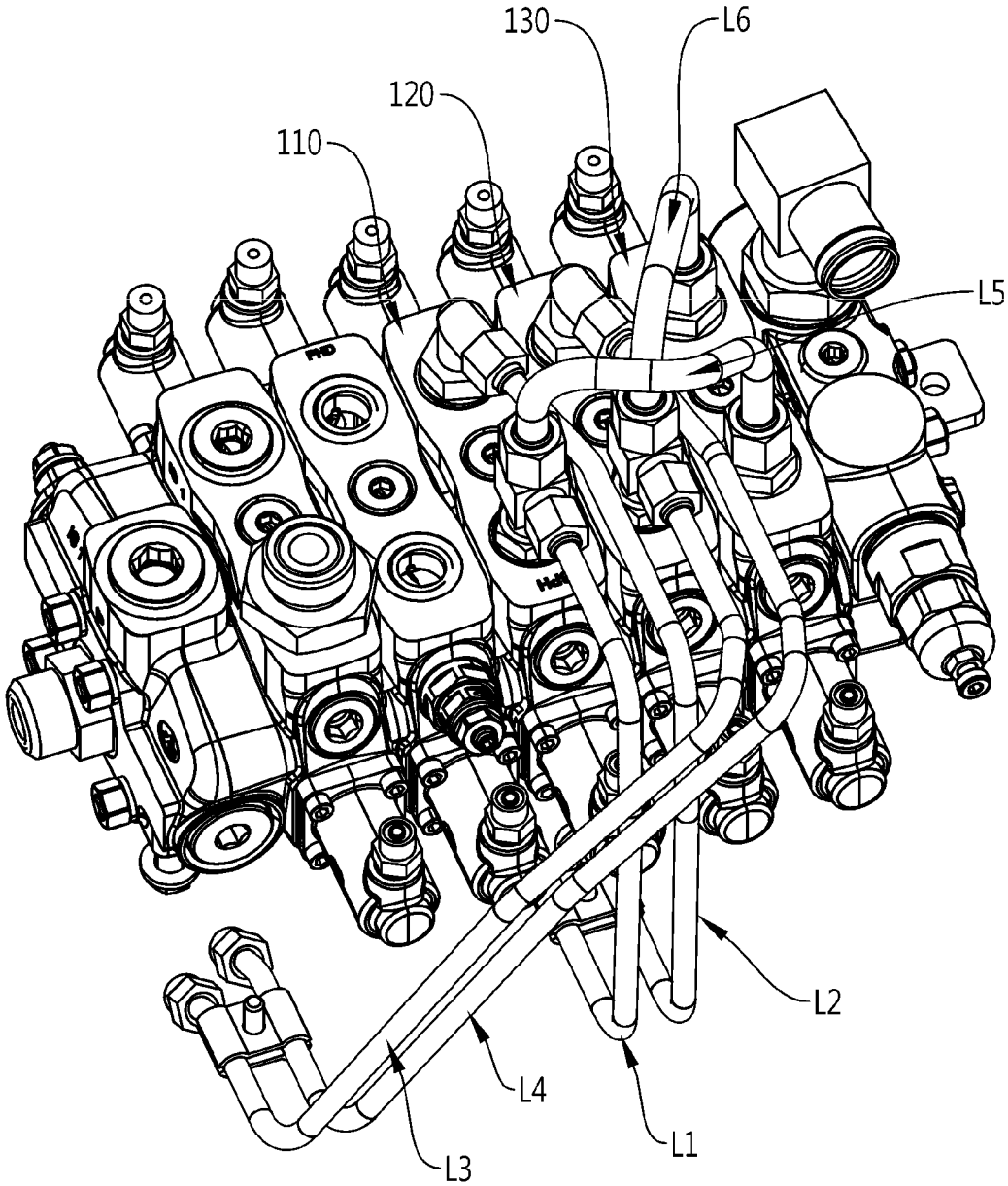
FIG. 6 is a perspective view of an example of a main control valve applied to a fork movement control device according to the exemplary embodiment of the present disclosure.
Figure 7:
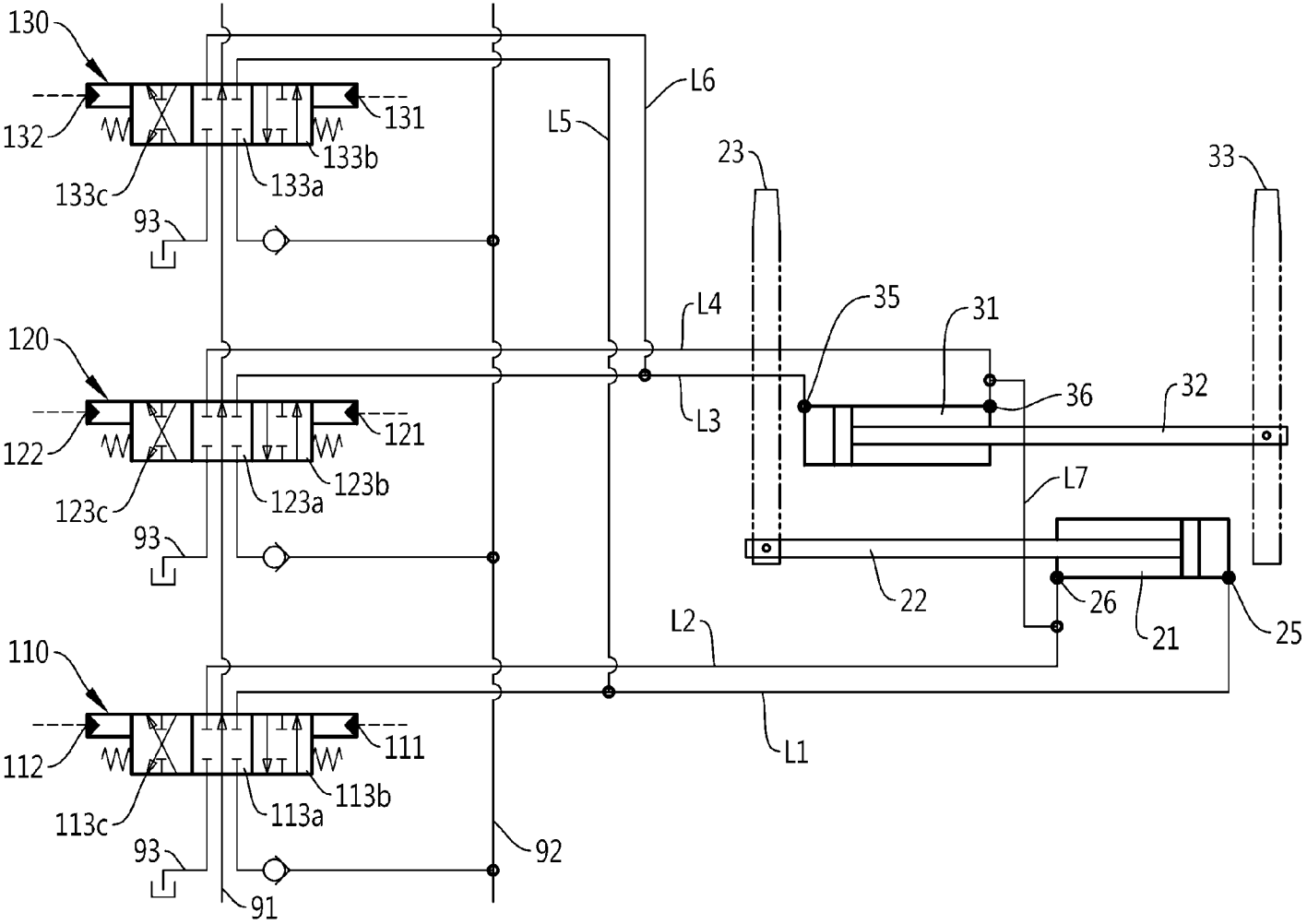
FIG. 7 is a schematic view of the fork movement control device according to the exemplary embodiment of the present disclosure.

Hereinafter, a fork movement control device according to the exemplary embodiment of the present disclosure will be described with reference to FIGS. 6 and 7. FIG. 6 is a view illustrating an example of a main control valve applied to the fork movement control device according to the exemplary embodiment of the present disclosure. FIG. 7 is a view for explaining the fork movement control device according to the exemplary embodiment of the present disclosure.

The main control valve may be configured by a combination of multiple control valves. In FIG. 6, only the control valve, among the multiple control valves, and only the hydraulic lines, which are involved in operating the forks, are denoted by reference numerals.

The fork movement control device according to the exemplary embodiment of the present disclosure includes a first control valve unit 110, a second control valve unit 120, and a third control valve unit 130.

The first control valve unit 110 is connected to a first head port 25 of the first cylinder 21 through a first flow path line L1 and connected to a first tail port 26 of the first cylinder 21 and a second tail port 36 of the second cylinder 31 through a second flow path line L2.

The first control valve unit 110 may include a first neutral position 113*a* at which a flow of a working fluid is stopped, a first forward direction position 113*b* at which the flow of the working fluid is controlled so that the working fluid flows in a forward direction, and a first reverse direction position 113*c* at which the flow of the working fluid is controlled so that the working fluid flows in a reverse direction.

In addition, the first control valve unit 110 includes an eleventh pressure receiving part 111 which allows the first forward direction position 113*b* to be selected, and a twelfth pressure receiving part 112 which allows the first reverse direction position 113*c* to be selected. In the first control valve unit 110, the first neutral position 113*a* is selected when no pilot pressure is applied to the eleventh and twelfth pressure receiving parts 111 and 112.

The second control valve unit 120 is connected to a second head port 35 of the second cylinder 31 through a third flow path line L3 and connected to a second tail port 36 of the second cylinder 31 through a fourth flow path line L4.

The second control valve unit 120 may include a second neutral position 123*a* at which the flow of the working fluid is stopped, a second forward direction position 123*b* at which the flow of the working fluid is controlled so that the working fluid flows in the forward direction, and a second reverse direction position 123*c* at which the flow of the working fluid is controlled so that the working fluid flows in the reverse direction.

In addition, the second control valve unit 120 includes a twenty-first pressure receiving part 121 which allows the second forward direction position 123*b* to be selected, and a twenty-second pressure receiving part 122 which allows the second reverse direction position 123*c* to be selected. In the second control valve unit 120, the second neutral position 123*a* is selected when no pilot pressure is applied to the twenty-first and twenty-second pressure receiving parts 121 and 122.

The third control valve unit 130 is connected to the first head port 25 of the first cylinder 21 through a fifth flow path line L5 and connected to the second head port 35 of the second cylinder 31 through a sixth flow path line L6. The third control valve unit 130 may include a third neutral position 133*a* at which the flow of the working fluid is stopped, a third forward direction position 133*b* at which the flow of the working fluid is controlled so that the working fluid flows in the forward direction, and a third reverse direction position 133*c* at which the flow of the working fluid is controlled so that the working fluid flows in the reverse direction.

In addition, the third control valve unit 130 includes a thirty-first pressure receiving part 131 which allows the third forward direction position 133*b* to be selected, and a thirty-second pressure receiving part 132 which allows the third reverse direction position 133*c* to be selected. In the third control valve unit 130, the third neutral position 133*a* is selected when no pilot pressure is applied to the thirty-first and thirty-second pressure receiving parts 131 and 132.

Meanwhile, the first tail port 26 of the first cylinder 21 and the second tail port 36 of the second cylinder 31 are connected to each other through a seventh hydraulic line L7.

Meanwhile, the fork movement control device according to the exemplary embodiment of the present disclosure includes a center bypass line 91 which allows the high-pressure working fluid to pass therethrough when the first, second, and third control valve units 110, 120, and 130 are at the neutral positions, and a parallel line 92 which allows the high-pressure working fluid to be provided to another of the first, second, and third control valve units 110, 120, and 130 while one of the first, second, and third control valve units 110, 120, and 130 operates. In addition, the fork movement control device according to the exemplary embodiment of the present disclosure has drain lines 93 which allow the working fluid discharged from the first, second, and third control valve units 110, 120, and 130 to flow into a tank.

Hereinafter, an operation of the fork movement control device according to the exemplary embodiment of the present disclosure, which is configured as described above, will be described with reference to the attached FIGS. 8 to 13.

<Process of Operating Only Left Fork>

Figure 8:
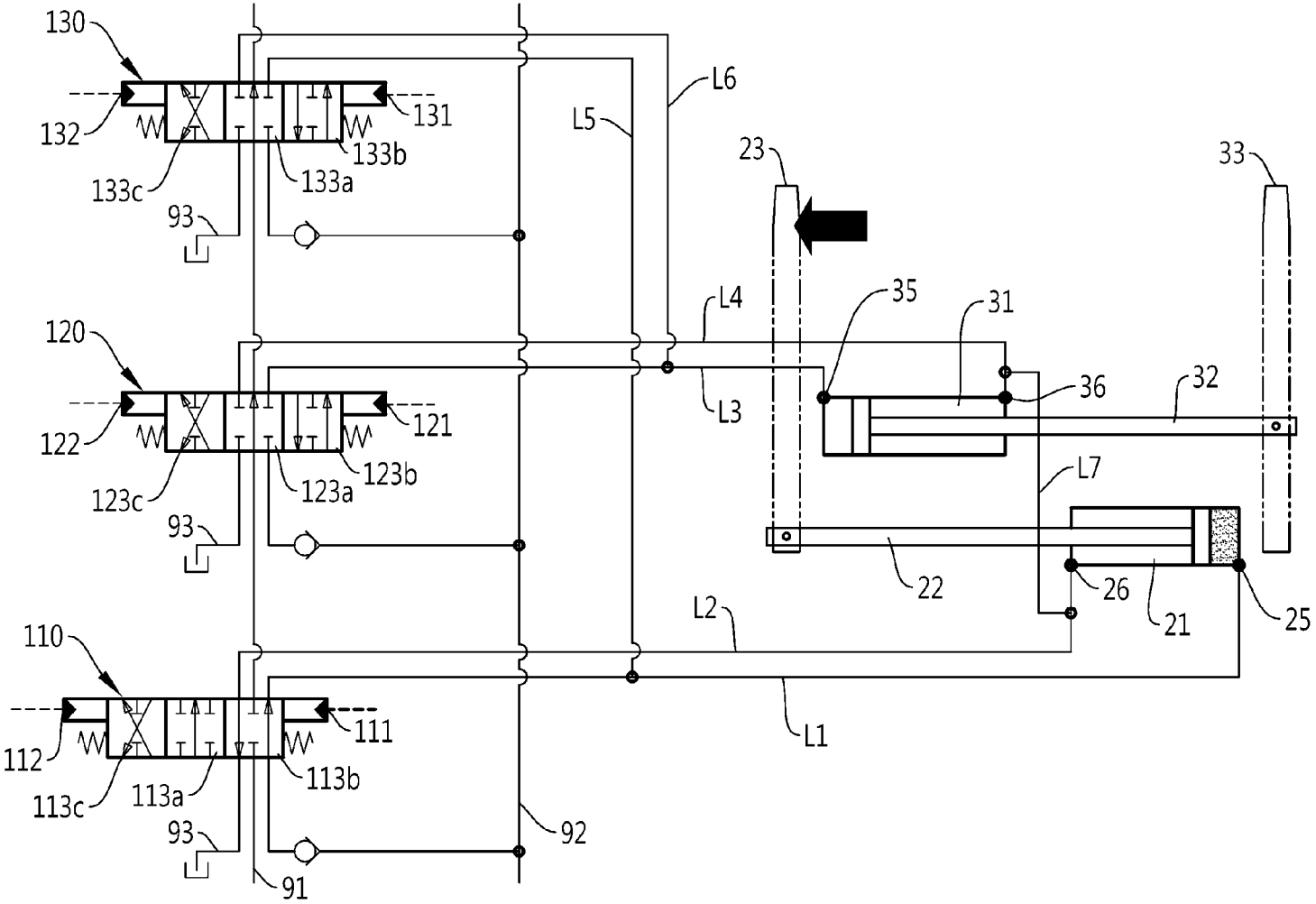
FIGS. 8 and 9 are each schematic views of an example in which the fork movement control device according to the exemplary embodiment of the present disclosure operates only a left fork.

As illustrated in FIG. 8, when the pilot pressure is applied to the eleventh pressure receiving part 111 of the first control valve unit 110, the working fluid is provided to the first head port 25, such that the first cylinder 21 is extended, and the first fork 23 is moved outward. The working fluid discharged from the first tail port 26 is discharged through the second flow path line L2.

Further, the first tail port 26 of the first cylinder 21 and the second tail port 36 of the second cylinder 31 are connected to each other, but the second and third control valve units 120 and 130 remain at the neutral positions 123*a* and 133*a*, and as a result, the working fluid cannot be discharged via the second and third control valve units 120 and 130. That is, the working fluid cannot be discharged from the second cylinder 31, and as a result, the second cylinder 31 does not operate.

Figure 9:
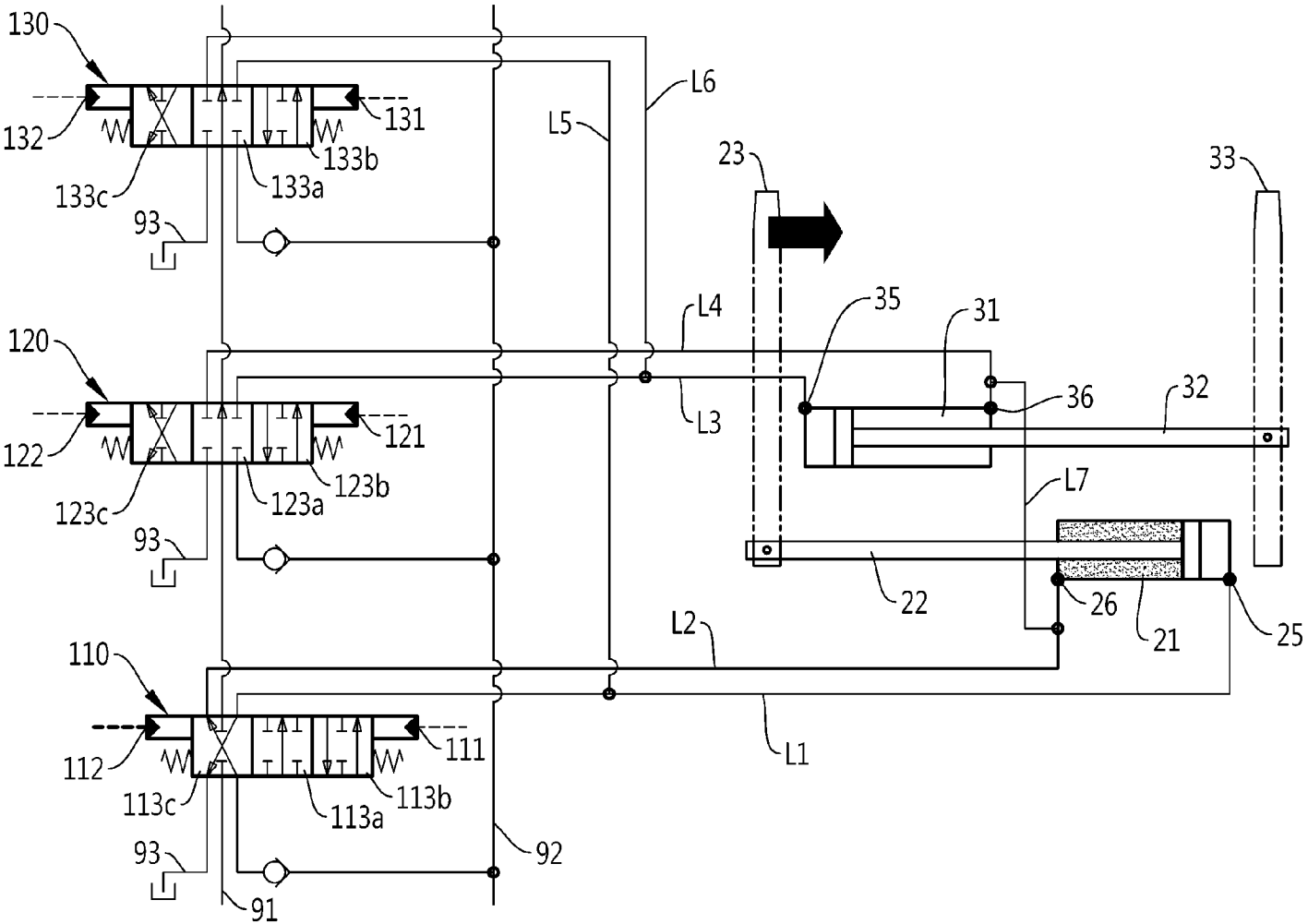

As illustrated in FIG. 9, when the pilot pressure is applied to the twelfth pressure receiving part 112 of the first control valve unit 110, the working fluid is provided to the first tail port 26, such that the first cylinder 21 is retracted, and the first fork 23 is moved inward. The working fluid discharged from the first head port 25 is discharged through the first flow path line L1.

Further, the first tail port 26 of the first cylinder 21 and the second tail port 36 of the second cylinder 31 are connected to each other, but the second and third control valve units 120 and 130 remain at the neutral positions 123*a* and 133*a*, and as a result, the working fluid cannot be discharged via the second and third control valve units 120 and 130. That is, the working fluid cannot be discharged from the second cylinder 31, and as a result, the second cylinder 31 does not operate.

Therefore, when a lever for controlling the first control valve unit 110 is manipulated, only the first cylinder 21 operates, and the second cylinder 31 does not operate.

<Process of Operating Only Right Fork>

Figure 10:
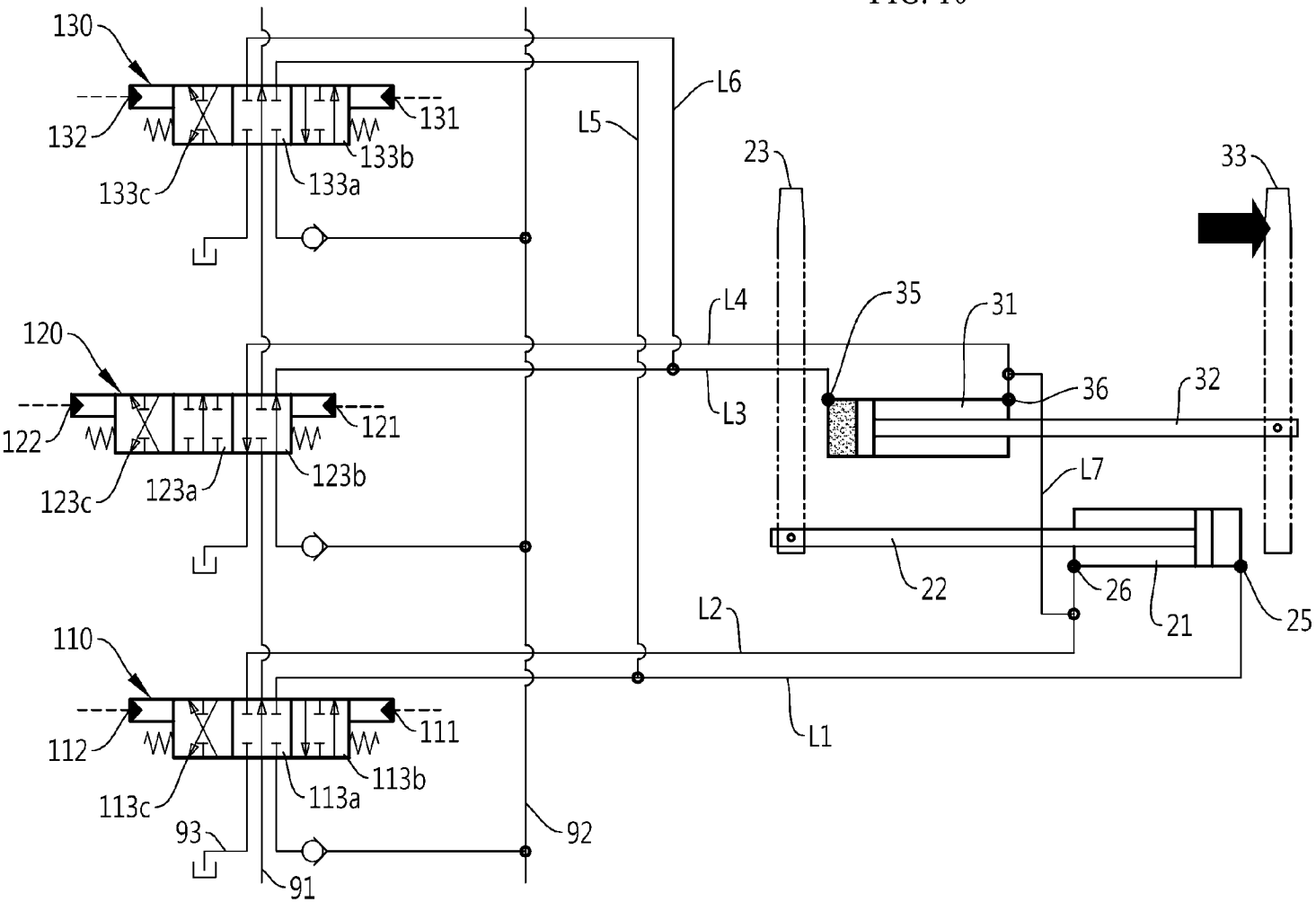
FIGS. 10 and 11 are each schematic views of an example in which the fork movement control device according to the exemplary embodiment of the present disclosure operates only a right fork.

As illustrated in FIG. 10, when the pilot pressure is applied to the twenty-first pressure receiving part 121 of the second control valve unit 120, the working fluid is provided to the second head port 35, such that the second cylinder 31 is extended, and the second fork 33 is moved outward. The working fluid discharged from the second tail port 36 is discharged through the fourth flow path line L4.

Further, the first tail port 26 of the first cylinder 21 and the second tail port 36 of the second cylinder 31 are connected to each other, but the first and third control valve units 110 and 130 remain at the neutral positions 113*a* and 133*a*, and as a result, the working fluid cannot be discharged via the first and third control valve units 110 and 130. That is, the working fluid cannot be discharged from the first cylinder 21, and as a result, the first cylinder 21 does not operate.

Figure 11:
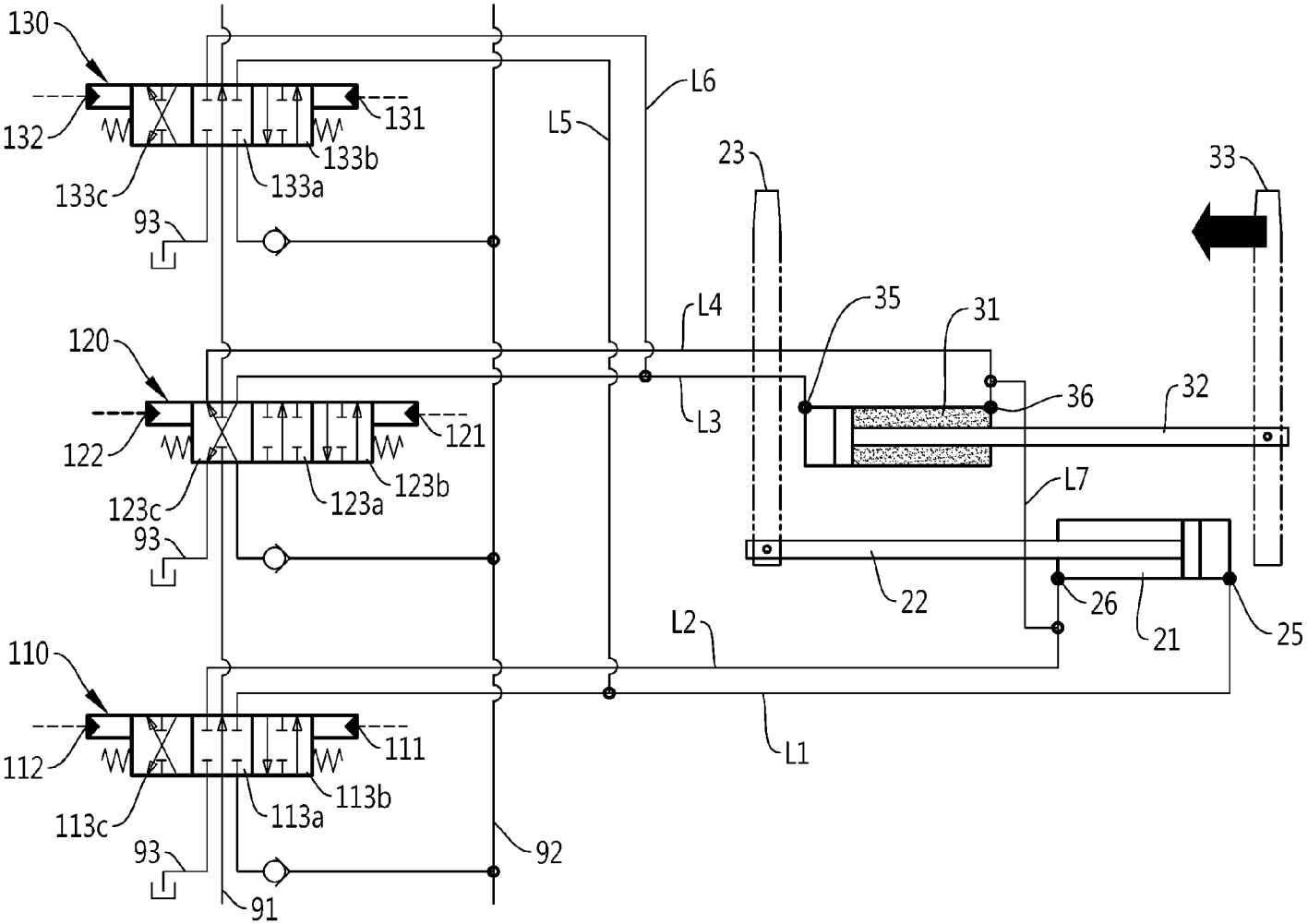

As illustrated in FIG. 11, when the pilot pressure is applied to the twenty-second pressure receiving part 122 of the second control valve unit 120, the working fluid is provided to the second tail port 36, such that the second cylinder 31 is retracted, and the second fork 33 is moved inward. The working fluid discharged from the second head port 35 is discharged through the third flow path line L3.

Further, the first tail port 26 of the first cylinder 21 and the second tail port 36 of the second cylinder 31 are connected to each other, but the first and third control valve units 110 and 130 remain at the neutral positions 113*a* and 133*a*, and as a result, the working fluid cannot be discharged via the first and third control valve units 110 and 130. That is, the working fluid cannot be discharged from the first cylinder 21, and as a result, the first cylinder 21 does not operate.

Therefore, when a lever for controlling the second control valve unit 120 is manipulated, only the second cylinder 31 operates, and the first cylinder 21 does not operate.

<Process of Simultaneously Operating Both of Two Forks>

Figure 12:
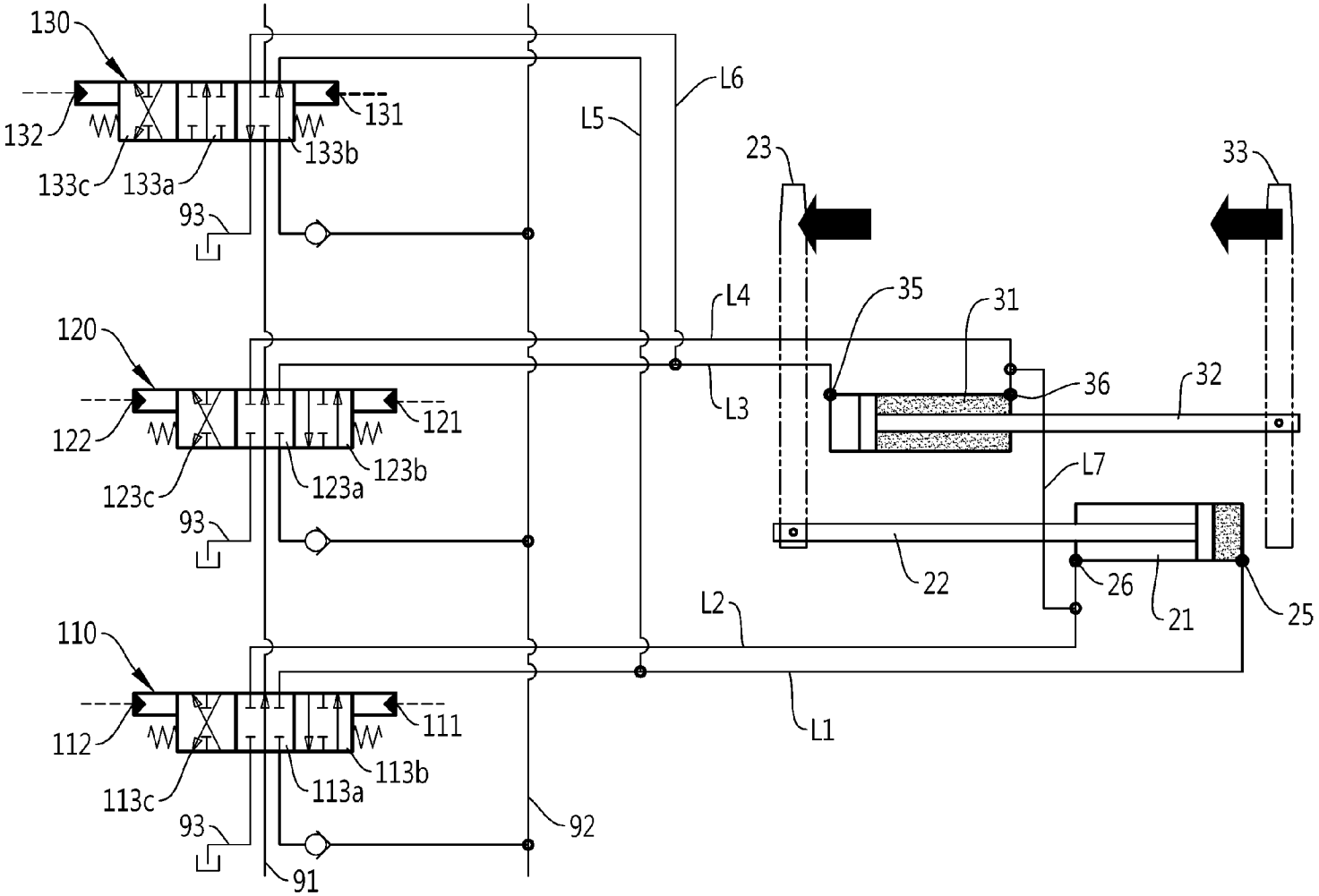
FIGS. 12 and 13 are each schematic views of an example in which the fork movement control device according to the exemplary embodiment of the present disclosure simultaneously operates both of the left fork and the right fork.

As illustrated in FIG. 12, when the pilot pressure is applied to the thirty-first pressure receiving part 131 of the third control valve unit 130, the working fluid is provided to the first head port 25 via the fifth flow path line L5 and the first flow path line L1, such that the first cylinder 21 is extended, and the first fork 23 is moved outward.

Meanwhile, because the first control valve unit 110 remains at the neutral position, the working fluid, which is discharged through the first tail port 26 of the first cylinder 21, cannot be discharged via the first control valve unit 110. Specifically, the first neutral position 113*a* of the first control valve unit 110 may be selected. Further, the working fluid, which is discharged from the first tail port 26, is provided to the second tail port 36 of the second cylinder 31 through the seventh flow path line L7, such that the second cylinder 31 is retracted, and the second fork 33 is moved inward.

The working fluid, which is discharged through the second head port 35 of the second cylinder 31, is discharged to the drain line 93 via the sixth flow path line L6 through the third control valve unit 130.

That is, when the pilot pressure is applied to the thirty-first pressure receiving part 131 of the third control valve unit 130, the first and second forks 23 and 33 may be simultaneously moved to the left, as illustrated in FIG. 12. Specifically, the pilot pressure is applied to the thirty-first pressure receiving part 131 of the third control valve unit 130, such that the third forward direction position 133*b* of the third control valve unit 130 may be selected.

Figure 13:
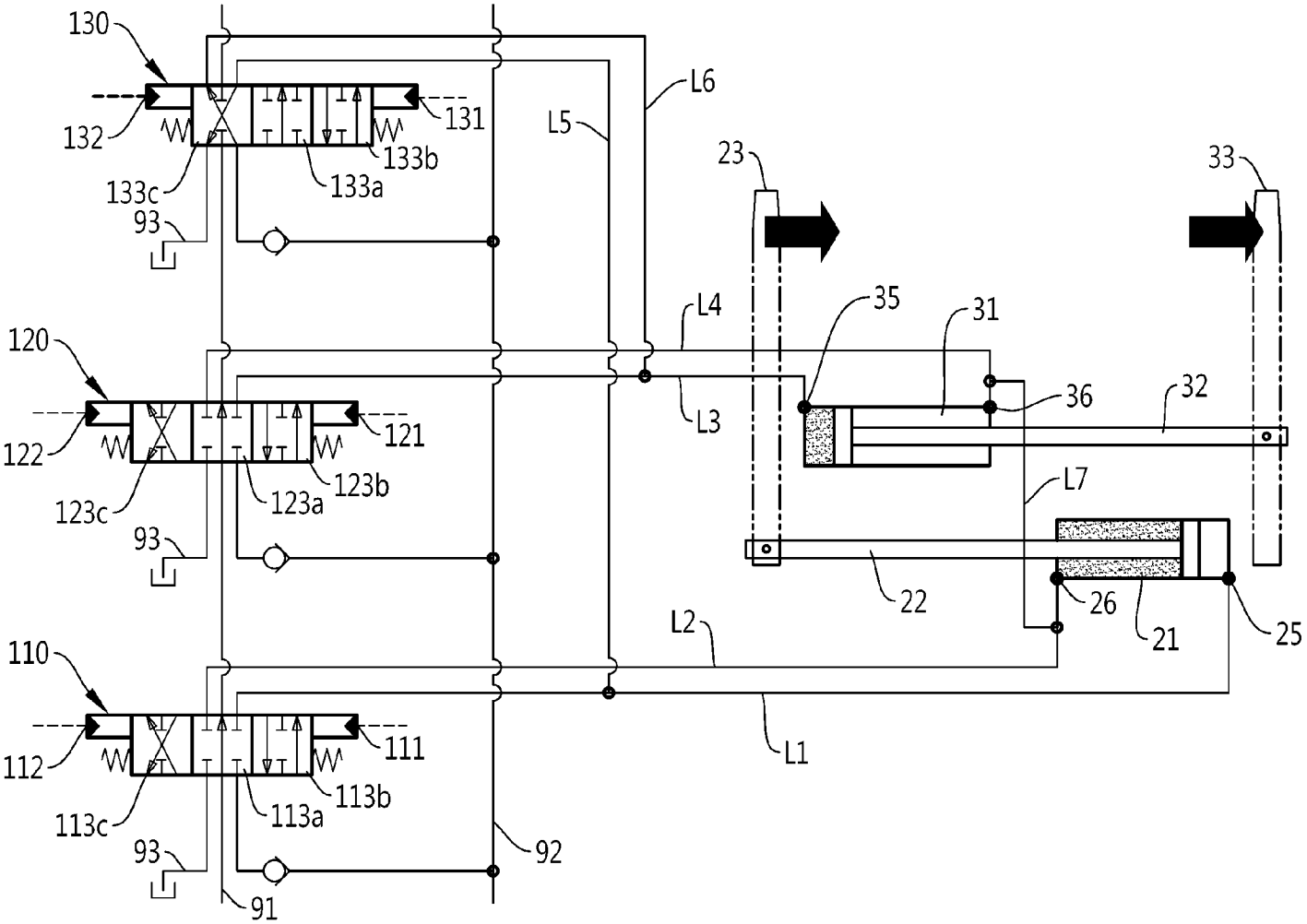

As illustrated in FIG. 13, when the pilot pressure is applied to the thirty-second pressure receiving part 132 of the third control valve unit 130, the working fluid is provided to the second tail port 35 via the sixth flow path line L6 and the third flow path line L3, such that the second cylinder 31 is extended, and the second fork 33 is moved outward. Specifically, the pilot pressure is applied to the thirty-second pressure receiving part 132, such that the third reverse direction position 133*c* of the third control valve unit 130 may be selected.

Meanwhile, because the second control valve unit 120 remains at the neutral position, the working fluid, which is discharged through the second tail port 36 of the second cylinder 31, cannot be discharged via the second control valve unit 120. Specifically, the second neutral position 123*a* of the second control valve unit 120 may be selected. Further, the working fluid, which is discharged from the second tail port 36, is provided to the first tail port 26 of the first cylinder 21 through the seventh flow path line L7, such that the first cylinder 21 is retracted, and the first fork 23 is moved inward.

The working fluid, which is discharged through the first head port 25 of the first cylinder 21, is discharged to the drain line 93 via the first flow path line L1 and the fifth hydraulic line L5 through the third control valve unit 130.

That is, when the pilot pressure is applied to the thirty-second pressure receiving part 132 of the third control valve unit 130, the first and second forks 23 and 33 may be simultaneously moved to the right, as illustrated in FIG. 12.

That is, the fork movement control device according to the exemplary embodiment of the present disclosure may simultaneously operate the first and second forks 23 and 33 by controlling the third control valve unit 130 even though the single shift cylinder 41 according to the comparative example is not provided.

In addition, according to the fork movement control device according to the exemplary embodiment of the present disclosure, it is possible to ensure a wider visual field of the operator in comparison with the comparative example because the side shift frame 50 according to the comparative example is excluded.

In addition, in the case in which the fork movement control device according to the exemplary embodiment of the present disclosure is applied to the forklift, it is possible to reduce costs incurred to manufacture the forklift because the single shift cylinder 41 and the side shift frame 50 according to the comparative example are excluded.

In addition, in the case in which the fork movement control device according to the exemplary embodiment of the present disclosure is applied to the forklift, it is possible to simplify the arrangement of the hydraulic lines because the hydraulic lines for operating the single shift cylinder 41 according to the comparative example may be excluded.

In addition, in the case in which the fork movement control device according to the exemplary embodiment of the present disclosure is applied to the forklift, it is possible to simplify the hydraulic lines because the single shift cylinder 41 and the side shift frame 50 are excluded, and it is possible to improve maintainability because associated accessories are excluded.

While the exemplary embodiments of the present disclosure have been described with reference to the accompanying drawings, those skilled in the art will understand that the present disclosure may be carried out in any other specific form without changing the technical spirit or an essential feature thereof.

Accordingly, it should be understood that the aforementioned exemplary embodiments are described for illustration in all aspects and is not limited, and the scope of the present disclosure shall be represented by the claims to be described below, and it should be construed that all of the changes or modified forms induced from the meaning and the scope of the claims, and an equivalent concept thereto are included in the scope of the present disclosure.

INDUSTRIAL APPLICABILITY

The fork movement control device according to the exemplary embodiment of the present disclosure may be used to control and simultaneously move the pair of forks.

The invention claimed is:

1. A fork movement control device comprising:

a pair of lift forks, including a first fork and a second fork;

a first control valve unit configured to control movement of the first fork of the pair of lift forks;

a first cylinder configured to provide power to move the first fork;

a first head flow path line guiding the movement of working fluid between a head port of the first cylinder and the first control valve unit;

a first tail flow path line guiding the movement of working fluid between a tail port of the first cylinder and the first control valve unit such that the first fork is moved in a first direction when working fluid is directed to the head port of the first cylinder;

a second control valve unit configured to control movement of the second fork of the pair of lift forks;

a second cylinder configured to provide power to move;

a second head flow path line guiding the movement of working fluid between a head port of the second cylinder and the second control valve unit;

a second tail flow path line for guiding the movement of working fluid between a tail port of the second cylinder and the second control valve unit such that the second fork is moved in a second direction when working fluid is directed to the head port of the second cylinder;

a third control valve unit configured to simultaneously move the first and second forks in the same direction;

a third head flow path line having one end connected to the third control valve unit and an opposite end joining the first flow path line to thereby communicate with the head port of the first cylinder;

a fourth head flow path line having one end is connected to the third control valve unit and an opposite end connected to the second head flow line to thereby communicate with the head port of the second cylinder; and a connecting tail flow path line having one end connected to the first tail flow path line and an opposite end connected to the second tail flow path line to thereby communicate with the tail ports of both the first and second cylinders, such that the first and second forks are simultaneously moved in the first direction when working fluid is directed to the head port of the first cylinder via the third head flow path line and the first and second forks are simultaneously moved in the second direction when working fluid is directed to the head port of the second cylinder via the fourth head flow path line such that:

when either the first control valve unit moves only the first fork or the second control valve unit moves only the second fork, working fluid discharged from the tail port of the first cylinder bypasses the connecting tail flow path line to be discharged through the first tail flow path line, or working fluid discharged from the tail port of the second cylinder bypasses the connecting tail flow path line to be discharged through the second tail flow path line.

2. The fork movement control device of claim 1, wherein the first control valve unit includes:

a first neutral position at which a flow of a working fluid through the first control valve is stopped;

a first forward direction position at which the flow of the working fluid is controlled so that the working fluid flows in a forward direction through the first control valve; and a first reverse direction position at which the flow of the working fluid is controlled so that the working fluid flows in a reverse direction through the first control valve, the second control valve unit includes:

a second neutral position at which the flow of the working fluid through the second control valve is stopped;

a second forward direction position at which the flow of the working fluid is controlled so that the working fluid flows in the forward direction through the second control valve; and a second reverse direction position at which the flow of the working fluid is controlled so that the working fluid flows in the reverse direction through the second control valve, and the third control valve unit includes:

a third neutral position at which the flow of the working fluid through the third control valve is stopped;

a third forward direction position at which the flow of the working fluid is controlled so that the working fluid flows in the forward direction through the third control valve; and a third reverse direction position at which the flow of the working fluid is controlled so that the working fluid flows in the reverse direction through the third control valve.

3. The fork movement control device of claim 2, wherein when the third forward direction position or the third reverse direction position of the third control valve unit is selected, the first neutral position of the first control valve unit is selected or the second neutral position of the second control valve unit is selected.

4. A forklift comprising the fork movement control device of claim 1.

* * * * *